US006689030B1

(12) United States Patent
Leslie

(10) Patent No.: US 6,689,030 B1
(45) Date of Patent: Feb. 10, 2004

(54) PHYSICAL THERAPY METHOD FOR TREATMENT OF SHOULDER MUSCLE AILMENTS AND STAFF USED THEREFORE

(76) Inventor: John C. Leslie, 23427 45th Ave., Cadott, WI (US) 54727

( * ) Notice: Subject to any disclaimer, the term of this patent is extended or adjusted under 35 U.S.C. 154(b) by 0 days.

(21) Appl. No.: 10/375,466

(22) Filed: Feb. 25, 2003

(51) Int. Cl.[7] ..... A63B 71/00

(52) U.S. Cl. ..... 482/148; 128/25 R; 482/139; 602/19; 602/20

(58) Field of Search ..... 482/148, 4, 130, 482/92, 908, 106; 128/24 R, 25 R; 602/19, 20; 5/662, 81.1 R; 135/84, 72, 82, 68, 77, 86, 88; 280/821

(56) References Cited

U.S. PATENT DOCUMENTS

| | | | | |
|---|---|---|---|---|
| 9,518 A | | 1/1853 | Gallaher, Jr. | |
| 3,199,886 A | | 8/1965 | Dover | |
| 4,684,125 A | | 8/1987 | Lantz | |
| 4,790,562 A | | 12/1988 | Skard | |
| 5,179,939 A | * | 1/1993 | Donovan et al. | 128/25 R |
| 5,588,942 A | | 12/1996 | Dillard | |
| 6,138,699 A | | 10/2000 | Su | |
| 6,276,007 B1 | * | 8/2001 | Brown | 5/81.1 R |

* cited by examiner

*Primary Examiner*—Nicholas D. Lucchesi
*Assistant Examiner*—L Amerson
(74) *Attorney, Agent, or Firm*—Anthony J. Bourget

(57) ABSTRACT

A physical therapy method for treatment of a patient's shoulder ailment and a staff for use of the same, the method comprising the steps of providing a staff for supporting the arm of the patient corresponding to the affected shoulder, the staff having a toe portion for maintaining contact with a surface, and an upper portion for engagement with the arm, maintaining the toe portion at a substantially stationary point on the surface, engaging the arm with the staff, and extending the arm in a spaced clearance position from the patient's body, whereby at least a portion of the weight of the patient's arm is supported by the staff to relieve pressure at the patient's affected shoulder to thereby allow the patient to obtain relief from and undertake treatment for a shoulder ailment.

24 Claims, 9 Drawing Sheets

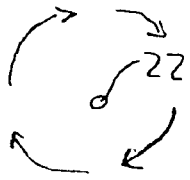
FIG. 7A
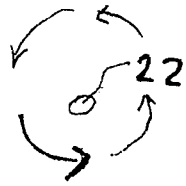
FIG. 7B
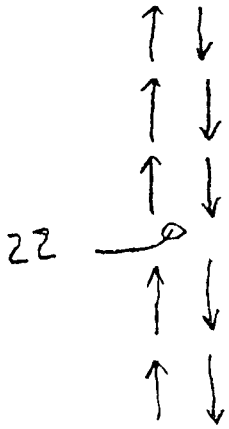
FIG. 7C
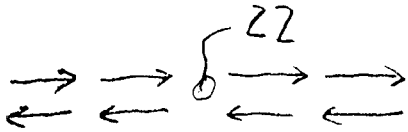
FIG. 7D
FIG. 7

PHYSICAL THERAPY METHOD FOR TREATMENT OF SHOULDER MUSCLE AILMENTS AND STAFF USED THEREFORE

FIELD OF THE INVENTION

This invention relates to a physical therapy method for treatment of shoulder muscle ailments, and more particularly to a therapy method for ambulating and rehabilitating the shoulder muscles of a patient who has undergone rotator-cuff or similar surgery.

DESCRIPTION—BACKGROUND OF PRIOR ART

People having undergone shoulder surgery or rotator cuff surgery experience a great deal of pain. As part of the recovery process the patient generally undergoes a physical therapy regimen. The physical therapy usually includes strength training and flexibility exercises to improve a range of motion, to lessen pain, and increase strength. Typically a physical therapy regimen is not even available to patients having undergone rotator cuff or similar shoulder operations for a period of 4 to 6 weeks following the injury or surgery. This is due to the tenderness of the shoulder area and the persistent pain associated with shoulder movements. While the pain tolerance of patients varies from person to person, it is often recognized that the sooner a patient begins therapy and working the muscles and attempting different range of motion exercises, the better the prospects are for the patient's recovery. The sooner a person can undertake regular physical therapy exercises, the sooner they are on the road to recovery, and generally the results will be better in terms of reducing pain, increasing range of motion, and establishing shoulder strength.

A major problem with recovery from shoulder surgery is the patient often is unable to even support the weight of his or her own arm. The patient generally will wear a sling and hold the arm close to his or her body. Extending the arm away from the body may cause sudden and severe shoulder pain. This is especially the case soon after surgery. Thus, it is often difficult for the recovering patient to have much mobility or to go about general tasks. If the patient were able to experience physical therapy sooner, the mobility would be greater and the road to recovery would be achieved much more quickly.

Another drawback of physical therapy recovery for shoulder surgery patients is that in the early stages of the recovery a trained therapist or other person is generally needed to assist in the exercises. This assistance is required so that the patient does not have to support his or her own arm. Instead, the therapist can hold up the arm/shoulder and work with the patient to establish range of motion. A difficulty in doing so is that the therapist and the patient do not have immediate communication as to what range of motion is tolerable. The patient would rather have immediate and total control over the range of motion so that the patient can determine his or her own tolerance of positions. To undergo such treatment also requires the therapist be on hand which is not always convenient or cost effective.

A further drawback of physical therapy recovery for shoulder surgery patients is that often the therapy cannot be conducted at home, or an elaborate mechanism or assistance is required. It is best to have available a portable device to assist with the therapy, and one that does not include elaborate pulleys or other complicated mechanical means.

It is thus an object of the present invention to provide an alternative therapy method for treatment of shoulder ailments and overcome the drawbacks and limitations of traditional therapy techniques.

It is also an object of the present invention to provide a therapy method for treatment of a shoulder ailment which the patient can complete alone or with minimal assistance from a therapist or other person.

It is also an object of the present invention to provide a therapy method for treatment of a shoulder ailment allowing the patient positioning of his arm or shoulder to undergo a variety of motion exercises.

It is also an object of the present invention to provide a therapy method for treatment of a shoulder ailment which allows the patient the ability to change the angle of the arm by raising or lowering the staff and moving the toe of the staff to different positions.

It is also an object of the present invention to provide a therapy method for treatment of a shoulder ailment which allows the patient to use a convenient and light-weight portable staff for undergoing exercise therapy.

It is also an object of the present invention to provide a therapy method for treatment of a shoulder ailment which allows the patient to exercise the shoulder muscles in different directions and in differing intensity levels.

It is also an object of the present invention to provide a therapy method for treatment of a shoulder ailment to allow the user to control his or her pain and/or rehabilitation regimen at whatever tolerance level or pace desired.

It is also an object of the present invention to provide a therapy method for treatment of a shoulder ailment to utilize a staff which includes a wrist wrap to allow the patient to relieve the shoulder from some or all weight bearing during exercise therapy.

These and other objects of the invention will become apparent in light of the present specification.

BRIEF SUMMARY OF THE INVENTION

The present invention is directed to physical therapy methods and staff for treatment of shoulder muscle ailments. One embodiment is directed to a method for treatment of a person who is limited in moving the shoulder muscles, the method comprising the steps of providing a staff for supporting the arm of the patient corresponding to the affected shoulder; the staff having a toe portion for maintaining contact with the surface, and an upper portion for engagement with the arm of the patient; maintaining the toe portion at a substantially stationery point on the surface; engaging the arm with staff, and extending at least a part of the arm in a spaced clearance position from the patient's body, whereby the weight of the patient's arm is supported by the staff to relieve pressure at the patient's shoulder to thereby allow the patient to obtain relief from and undertake treatment for a shoulder ailment.

A further embodiment is directed to a physical therapy method for treatment of an ailment of the shoulder of a patient and using a staff having a toe portion and an upper portion, the method comprising the steps of maintaining the toe portion of the staff at a stationary point on a surface, engaging the staff with the patient's arm corresponding to the patient's ailing shoulder; extending the patient's arm in a spaced clearance position from the patient's body, and ambulating the patient's arm and the staff to treat the ailing shoulder.

A further embodiment is directed to a physical therapy method of ambulating the shoulder muscles of a patient having undergone rotator-cuff surgery and unable to independently sustain extension of the arm from the body, the method comprising the steps of selecting a staff of selected length size as measured from a toe portion to an upper portion of the staff, engaging the arm with the upper portion of the staff, and extending the arm in a spaced clearance position from the body while maintaining the toe portion at a substantially stationary point on a surface, whereby the patient's arm is supported by the staff so that a patient may treat the shoulder muscles having undergone surgery.

A further embodiment is directed to an adjustable staff for use in therapeutic shoulder treatment of the type involving engaging the staff with the arm of a patent and extension of the arm of the patient from the body of the patient while maintaining the staff in stationary contact with a surface, the staff comprising a first length of supporting material defining a surface-engaging member, a second length of supporting material defining an arm-engaging member, a screw fastener for length-wise adjustability connecting the surface-engaging member with the arm-engaging member, and a wrist wrap in attached relation to the arm-engaging member and having a loop for receiving and suspending the wrist of a patient during operation of the shoulder treatment.

BRIEF DESCRIPTION OF THE DRAWINGS

FIGS. 7A–D include top views of the staff used in the present invention depicting various rotational and linear movements of the staff.

DETAILED DESCRIPTION OF THE PREFERRED EMBODIMENTS

Figure 1:
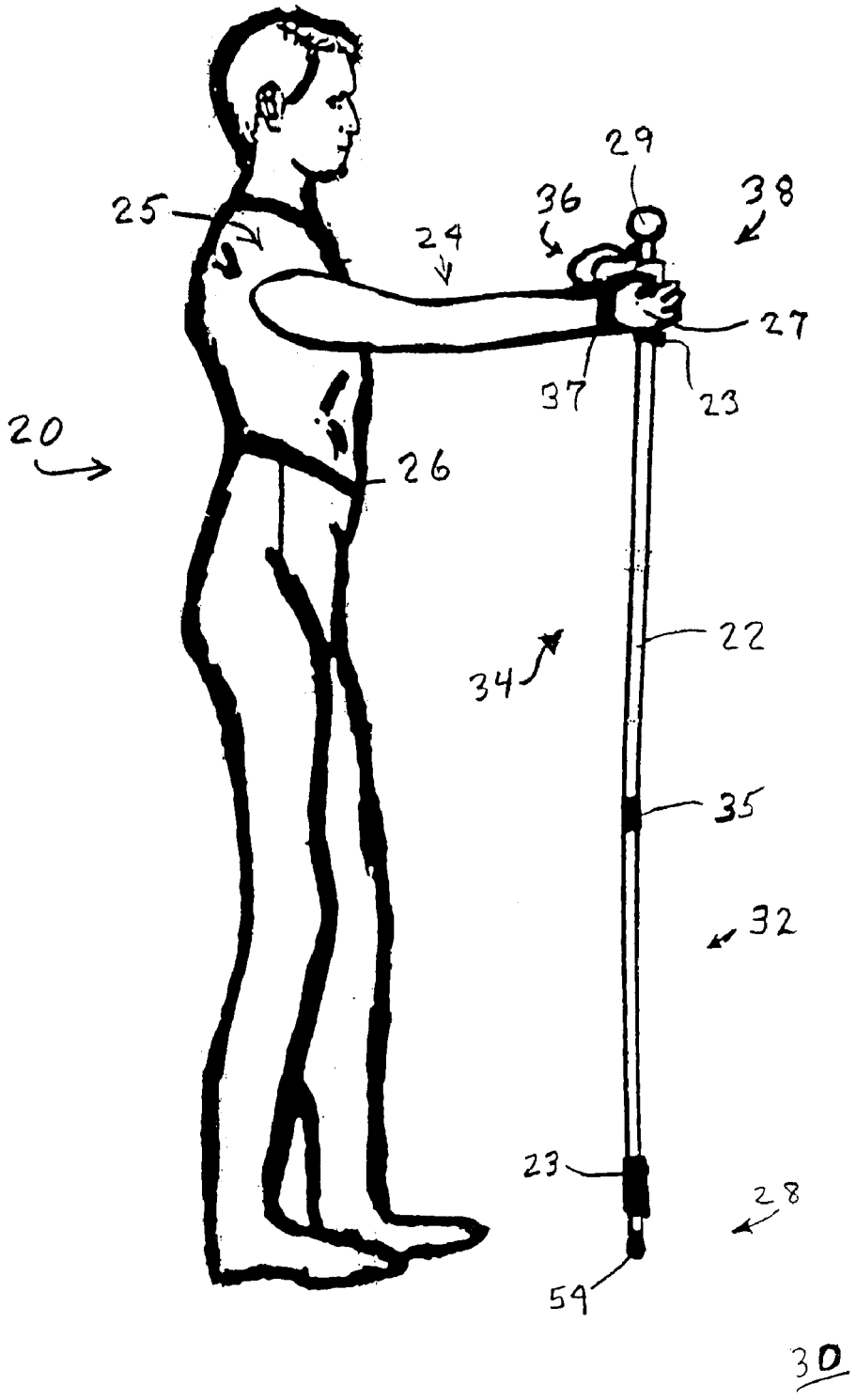
FIG. 1 is a right side perspective view of a patient utilizing the therapy method in accordance with the present invention.

FIG. 1 shows a patient 20 engaging a staff 22 to utilize the method of the present invention. Staff 22 includes a toe portion 28 for maintaining contact with a surface 30. The surface 30 is typically the floor, but may also include a wall, ceiling, or other surface that will not move in response to forces placed on staff 22. Staff 20 must be made of material sufficient to support the weight of a person's arm together with the forces applied by the person when undergoing the present therapy treatment. Preferably staff 20 is height-adjustable and includes a lower segment 32 and upper segment 34. Lower segment 32 includes a first length of supporting material deferring a surface-engaging member. Upper segment 34 includes a second length of supporting material deferring an arm-engaging member. At least one quick-release screw fastener 35 is used to join lower segment 32 and upper segment 34. Screw fastener 35 accomodates length-wise adjustability for connecting the surface-engaging member with the arm-engaging member. Staff 22 may be multi-segmented to allow for convenient use, transportation and storage. Preferably, portable staff 22 is telescoped to a length of approximately three feet and extends to a length of approximately six feet. Unscrewing fastener 35 allows the user to adjust the height of staff 22 to accommodate a variety of lengths for a variety of therapy maneuvers. Fastener 35 is then tightened to hold staff 22 at the desired length. Patient 20 may conveniently carry staff 22 and adjust staff 22 for a variety of individual therapy uses.

Wrist wrap 36 is attached at an upper portion 38 of staff 22. Wrist wrap 36 includes a loop or strap 37 which defines a loop for receiving the wrist of patient 20. Wrist wrap 36 secures to the patient's arm 24 at the wrist location generally as shown. Wrist wrap 36 operates like a sling to hold the weight of arm 24. Patient 20 may allow his hand and wrist to lie limp within the wrist wrap 36 or otherwise suspend or hang his arm from wrist wrap 36. Patient 20 may also grasp staff 22 with hand 27. Grasping may occur on the staff 22 or, if desired, at knob 29. Staff 22 includes grips 23 if desired. Wrist wrap 36 is usable as a guide to assist in absorbing some or all of the weight of the arm 24. While the weight of arm 24 may be absorbed by staff 22 in general, the patient 20 must nonetheless balance staff 22, thus, some of the muscles of the shoulder 25 are utilized for stability. Such stabilizing is one of many therapy aspects presented with the present invention.

Figure 8:
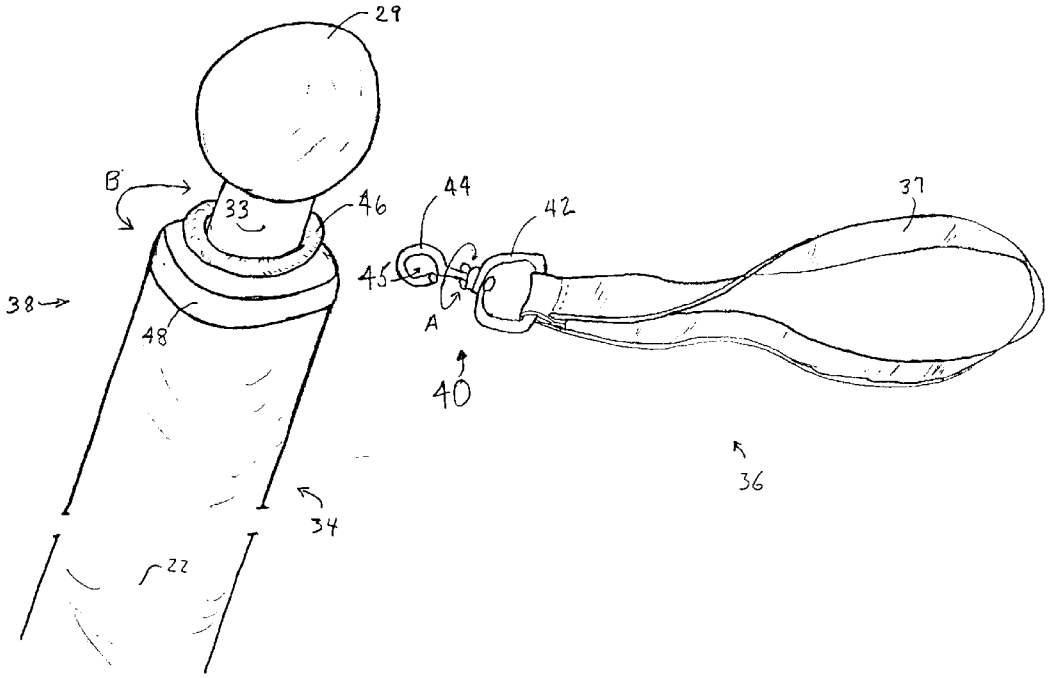
FIG. 8 is a perspective view of the staff of the present invention showing the wrist wrap adjacent and not yet connected with staff 22.

It can be appreciated that wrist wrap 36 can be connected to staff 22 in many ways. Preferably, and as shown in FIG. 8, wrist wrap 36 includes a swivel 40 for connecting to staff 22. Swivel 40 includes at one end a receiver 42 for receiving strap 37 and at the other end a hook 44. Hook 44 and receiver 42 swivel about each other as shown at arrow A. Hook 44 attaches to staff 22, and preferably does so at O-ring 46. While not shown, it can be appreciated that hook 44 attaches to O-ring 46 by positioning O-ring 46 within aperture 45. O-ring 46 is preferably made of flexible rubber. O-ring 46 is flexible or has a selected diameter to provide sufficient clearance from knob stem 33 to allow hook 44 to slide around staff 22 in the direction of arrow B. Wrist wrap 36 thus accommodates for swivel of strap 37 and circulation of strap 37 around staff 22 so that a patient 20 has free movement. The swivel action and circulation action allow for use of staff 22 without undue entanglement of strap 37 about staff 22 or about the wrist of a patient 20.

Knob 29 preferably includes internal threads (not shown) for attachment to a threaded post (not shown) extending from staff 22. Preferably a plastic washer 48 is positioned on staff 22 at upper portion 38 as shown. It can be appreciated that various or multiple washers 48 having the same or varying diameters may be selected for attachment to staff 22.

Figure 9:
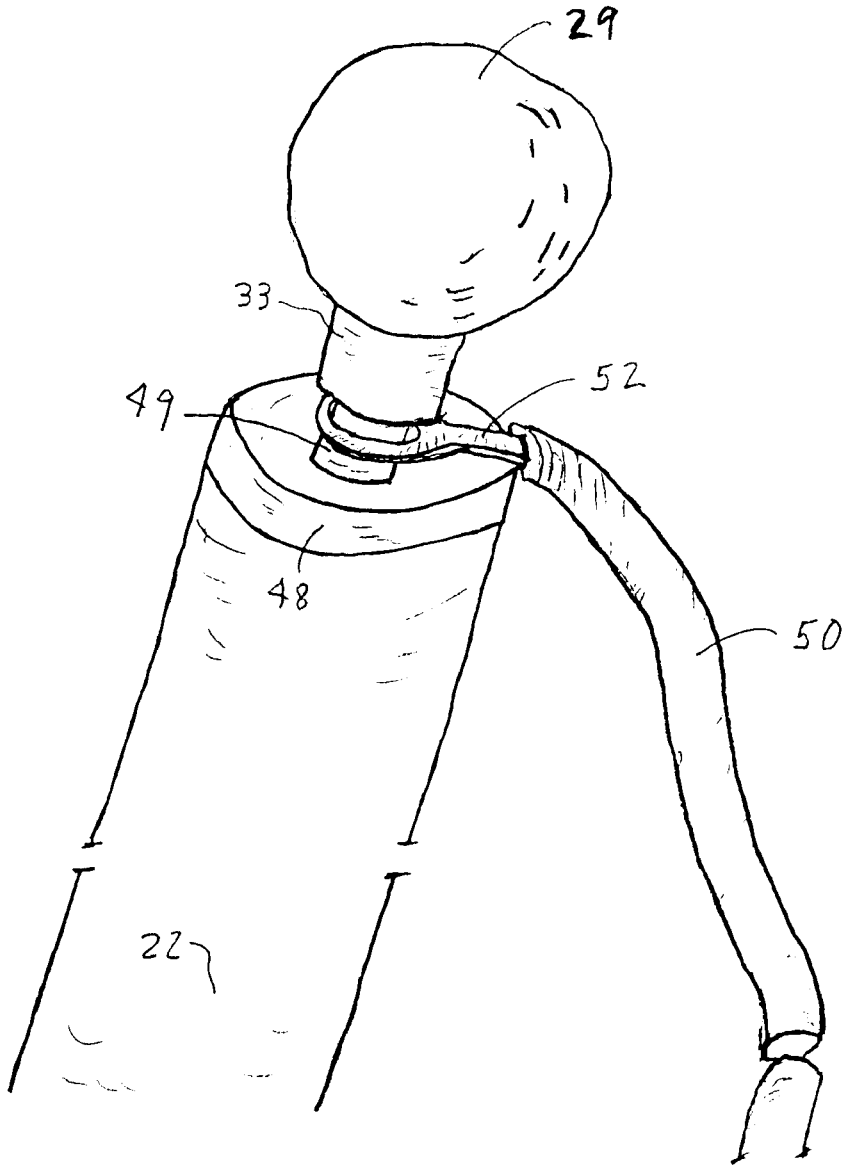
FIG. 9 is a perspective view of the staff of the present invention showing connection of a therapy band.

As shown in FIG. 9, washer neck 49 has diameter less than the diameter of washer 48. Preferably, washer neck 49 is positioned over threaded post (not shown). Washer neck 49 receives therapy band 50. Therapy band 50 is preferably made of strong flexible rubber or bands useful for resistance exercise, such as Thera-Band® rubber hosing. Therapy band 50 includes connector 52 for connection around washer neck 49 as shown. It can be appreciated that a variety of therapy bands 50 or other items may be similarly attached to staff 22. While not shown, the other end of therapy band 50 may be similarly attached to toe portion 28, where toe 54 may also include internal threads for connection to staff 22. A variety of washers 48 or washer necks 49 may also be utilized at toe portion 28 to accommodate connection of a variety of therapy bands 50 or other items. It can be appreciated that both a therapy band 50 and wrist wrap 36 may be simultaneously connected to staff 22. Also, therapy band 50 and wrist wrap 36 may each be connected to staff 22 using the connecting features of the other as described above.

In operation according to the invention shown in FIG. 1, a staff 22 is provided for patient 20. Patient 20 has limited ability in the movement of his shoulder muscles, as is often the case after undergoing shoulder surgery, especially rotator-cuff repair surgery or surgery involving the muscles of the shoulder. In FIG. 1, patient 20 has an affected right arm 24 corresponding to the affected or injured right shoulder 25. It may be appreciated that the therapy method may be used to treat either an affected right or left shoulder, or both. Toe portion 28 is maintained at a stationary position on the surface 30 throughout the therapy operation. Arm 24 is engaged with staff 22. Patient 20 then extends his arm 24 in a spaced clearance position from his body 26. As shown in FIG. 1, arm 24 is fully extended with the elbow being "locked." Fully extending arm 24 is preferred, but is not always accomplished or tolerable by patient 20. It can be appreciated that arm 24 might be only partially extended (yet, still in a spaced clearance position from the body). The arm 24 is extended in a spaced clearance position from the body 26 when at least a portion of the arm 24, which may include, for instance, the hand 27, is not in contact with the body 26. When arm 24 is extended in a spaced clearance position from body 26, the weight, or a portion of the weight, of arm 24 is supported by staff 22. Such weight supporting feature relieves pressure at the shoulder 25 to allow patient 20 to obtain relief from a shoulder ailment. One therapy aspect involves the patient partially extending the arm to obtain a range of motion while experiencing little or no pain.

While the arm 24 is supported by staff 22 the. patient 20 ambulates staff 22. Staff 22 is ambulated by patient 20 by using the muscles of shoulder 25, or by leaning body 26 toward or away from staff 22, by bending at the hips or knees, or a combination of the foregoing. Ambulating the staff may also occur by bending the elbow. It can be appreciated that ambulating may occur in any number of directions, including clockwise or counterclockwise rotations, or various linear movements as shown in FIGS. 7A–D, or combinations of such rotations or movements. Preferably, patient 20 fully extends his arm to expose the shoulder to greater ranges of movement. Typically, such exposure is not accomplished due to pain, however, use of staff 22 supports at least a portion of the weight of arm 24 which allows patient 20 to control the range of movement and also the amount of pain. It can be appreciated that staff 22 may also remain in a substantially stationary position while patient 20 moves about staff 22 while engaging it with arm 24. In such fashion patient 20 may move his body to control the range of shoulder movement while keeping the staff relatively stationary. Patient 20 ambulates the arm to desired positions as tolerated or as recommended by a treating therapist.

Soon after rotator-cuff surgery a patient 20 is usually unable to extend his arm 24 from his body 26. Also, griping with the hand is often intolerable. Use of a wrist wrap 36 is thus important for engaging arm 24 with staff 22. A further step in the method described above includes engaging the arm with the staff with the use of a wrist wrap 36 connected to staff 22. Such step allows arm 24 to be engaged while yet being suspended from staff 22.

Figure 2:
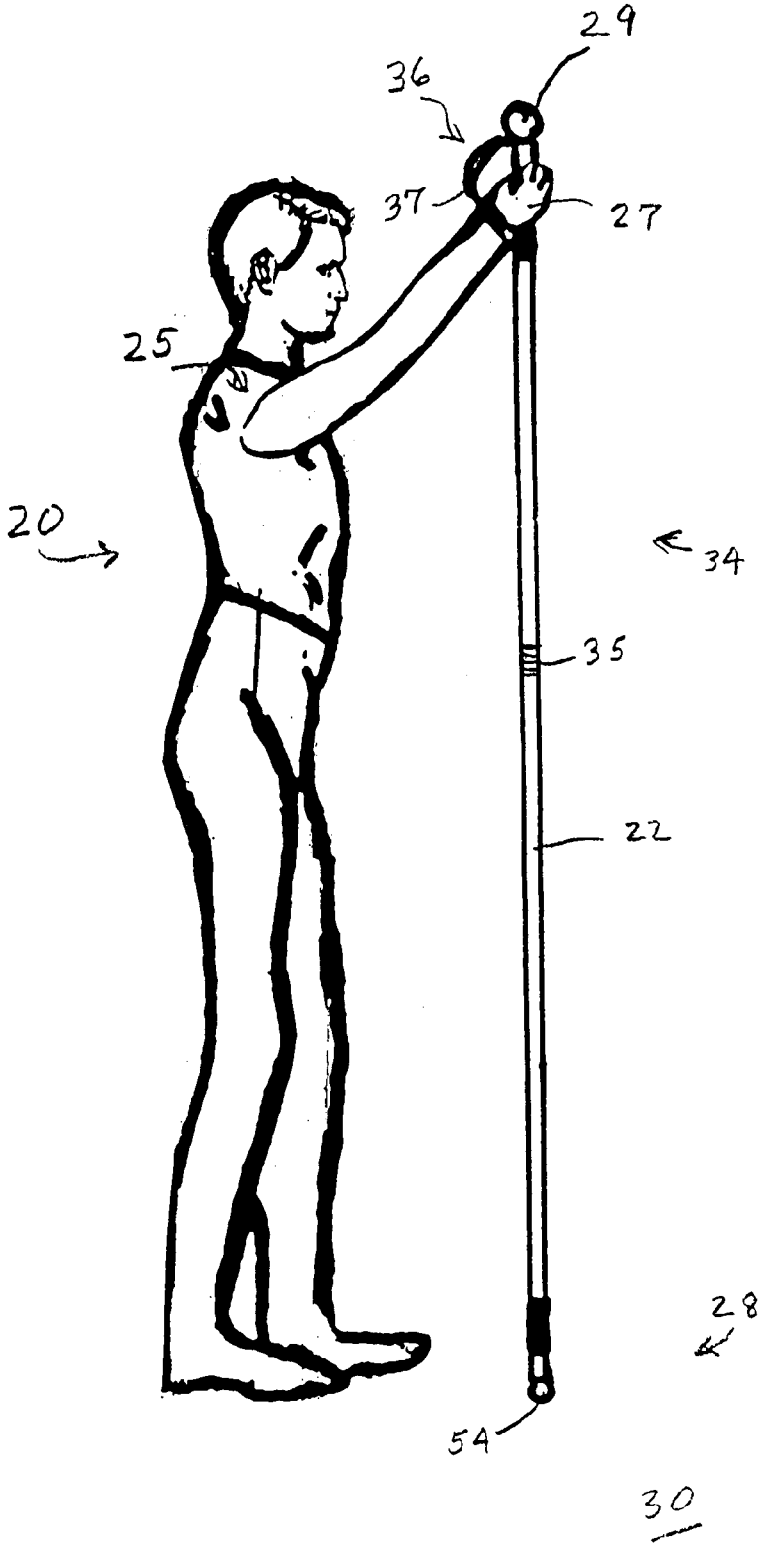
FIG. 2 is a right side perspective view of the therapy method of FIG. 1 wherein the staff height and shoulder angle are changed.
Figure 3:
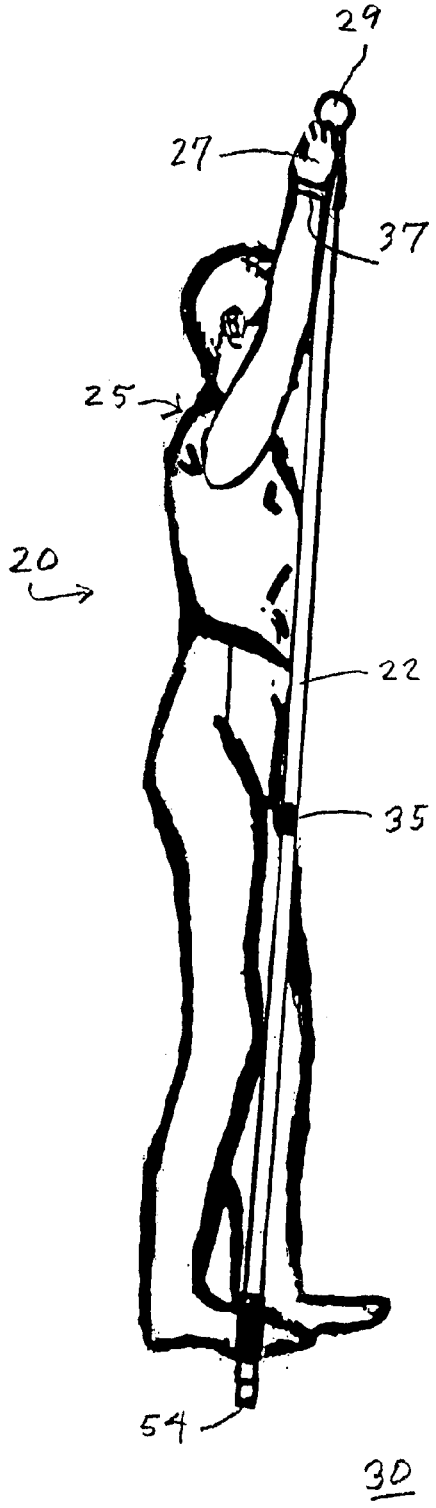
FIG. 3 is a right side perspective view of the therapy method of FIG. 1 wherein the staff height and shoulder angle are changed.

As shown in FIGS. 2 and 3, patient 20 utilizes the same methods shown above, and in addition, is able to modify the angles of shoulder movements by adjusting the length of staff 22. Patient 20 may adjust or obtain a staff 22 of selected length size (as measured from the toe portion 28 to the upper portion 38), depending on the desired ranges of motions or height of shoulder/arm positioning for the intended therapy. The various rotations and movements shown in FIGS. 7A–D, or combinations of the same, can be used in the steps shown in all figures. As shown in FIGS. 7 A and 7B, the staff 22 may be rotated about the vertical axis extending through the staff 22. The axis generally extends through staff 22 vertically from toe portion 28 through knob 29. The modified angles allow for stretching of the shoulder muscles at different angles. Quick release screw fastener 35 is of common variety and allows for desired adjustment of the length of staff 22. The step shown in FIG. 3 and in the other Figures also allows patient 20 to undergo both ambulation and isometric exercise and stretching.

Figure 4:
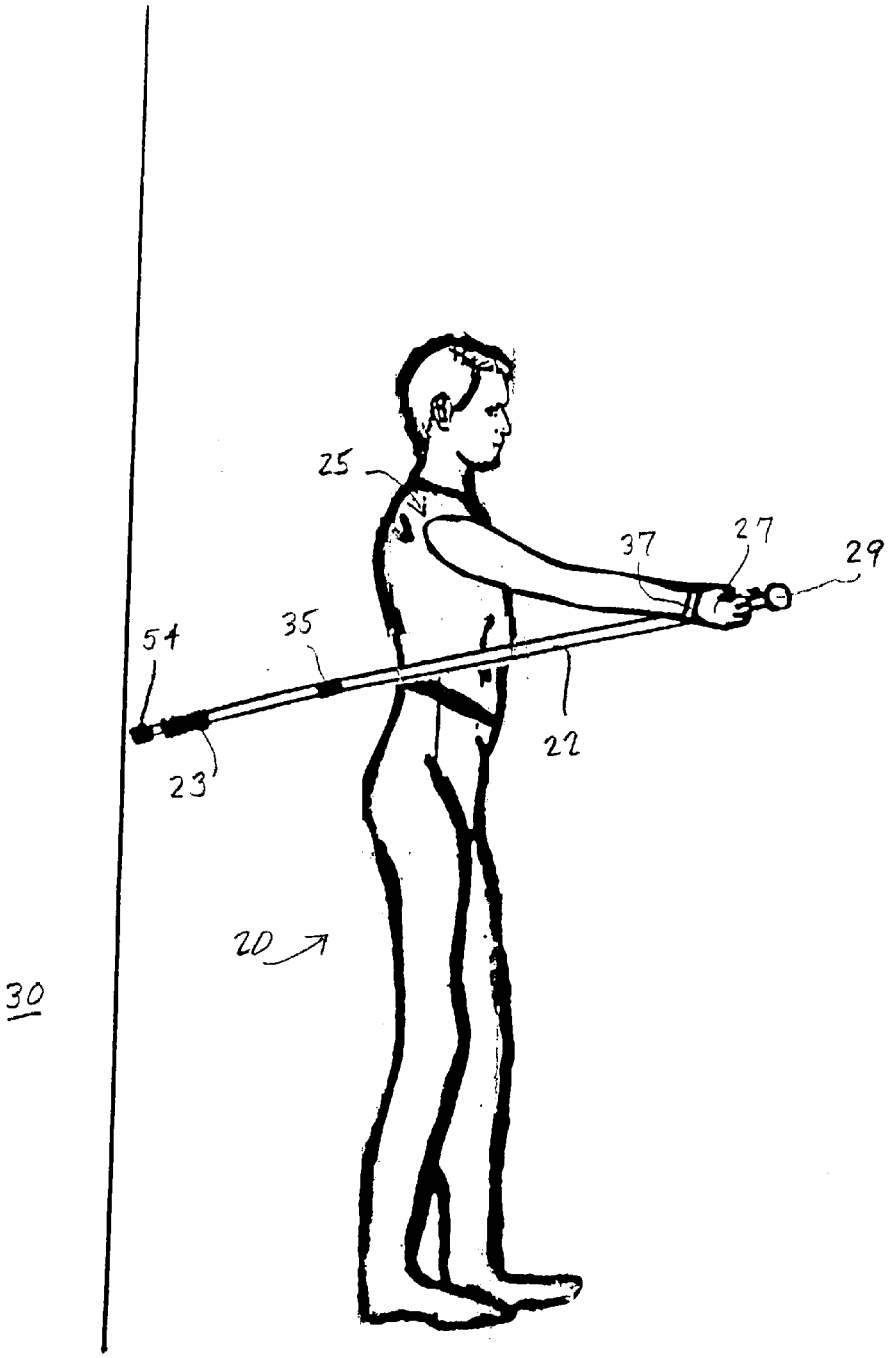
FIG. 4 is a right side perspective view of the therapy method of FIG. 1 wherein the staff is positioned against a wall.
Figure 5:
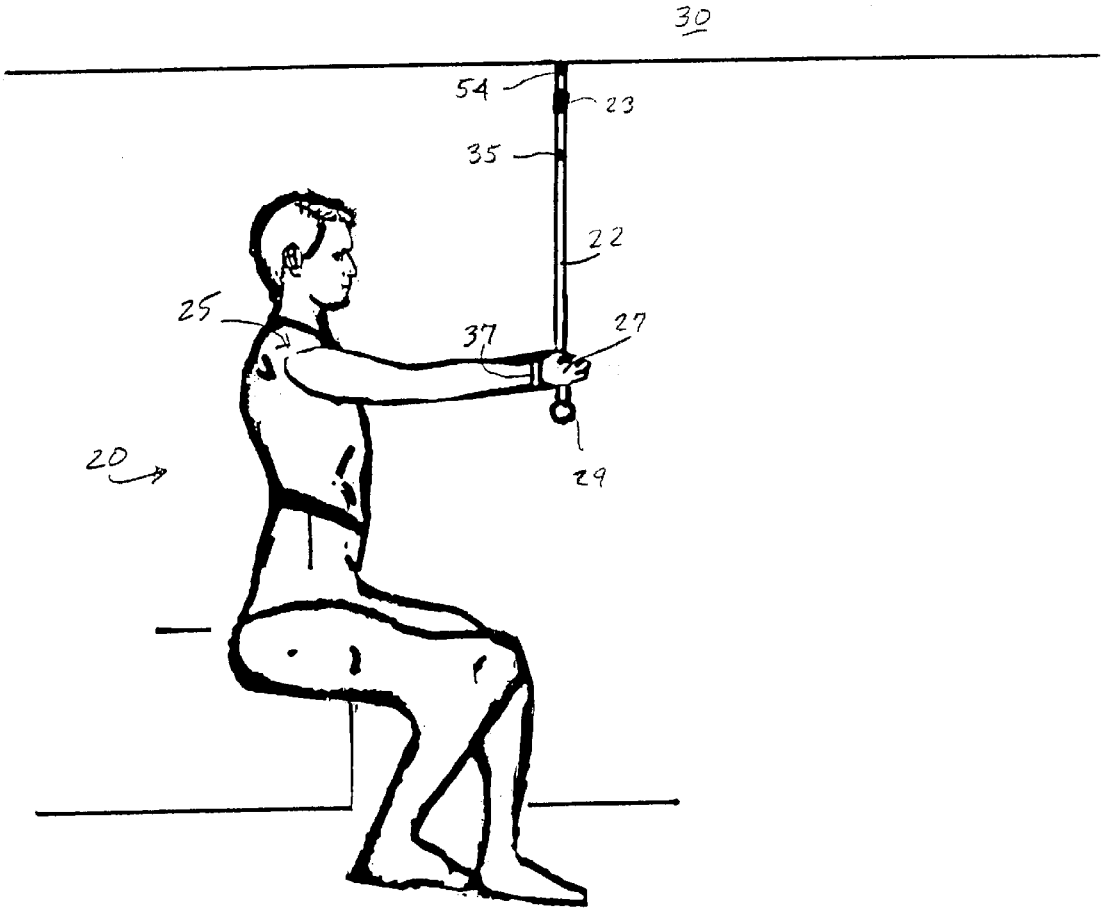
FIG. 5 is a right side perspective view of a seated patient utilizing the therapy method of the present invention wherein the staff is positioned against a ceiling.

As shown in FIG. 4, the method includes the step of maintaining the toe portion 28 of the staff 22 at a substantially stationary point on a vertical surface such as a wall, and FIG. 5 shows maintaining the staff 22 on an overhead surface such as the ceiling. Various isometric presses and ambulation angles are achieved in using these steps.

Figure 6:
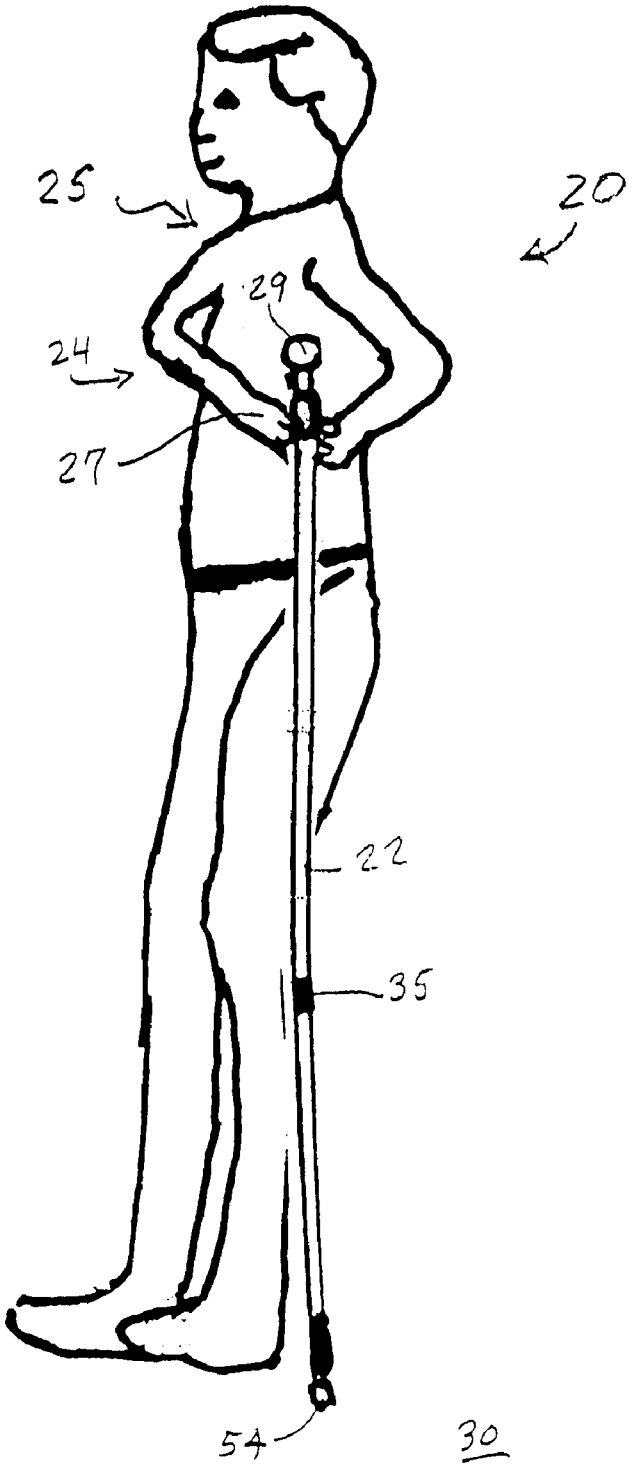
FIG. 6 is a left side perspective view of a patient utilizing the therapy method of a further aspect of the present invention.

As shown in FIG. 6, patient 20 positions toe portion 28 adjacent his left foot. While reaching across his body 26 with affected right arm 24, he engages staff 22. While engaged, patient 20 pulls staff 22 rearward with the assistance of non-affected left arm. This step allows patient 20 to exercise and stretch right shoulder 25.

The adjustable staff 22 described above may be used in each of the above-described methods.

In operation, a patient 20 may also utilize therapy band 50 for muscle exercise in conjunction with the above techniques. Therapy bands 50 provide patient 20 with convenient opportunity for a variety of shoulder stretching and isometric exercise.

The above methods allow patient 20 to ambulate the arm and staff to precise positions as determined by the patient in accordance with the patient's pain tolerances. A number of factors will enter into the appropriate positioning as determined by the patient, with or without the assistance of a therapist, including, desired hand angle, arm angle, arm extension, arm rotation, degree of arm separation from the body, direction of motions, intensity of isometric resistance, age of patient, age of injury, and other factors relating to physical therapy and healing.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

I claim:

1. A physical therapy method for treatment of a patient's affected shoulder ailment, said method comprising the steps of:

providing a staff for supporting the arm of the patient corresponding to the affected shoulder, the staff having a toe portion for maintaining contact with a surface, and an upper portion for engagement with the arm;

maintaining the toe portion at a substantially stationary point on the surface;

engaging the arm with the staff;

extending the arm in a spaced clearance position from the patient's body;

whereby at least a portion of the weight of the patient's arm is supported by the staff to relieve pressure at the patient's affected shoulder to thereby allow the patient to obtain relief from and undertake treatment for a shoulder ailment.

2. The therapy method of claim 1 wherein said method includes the step of ambulating the staff.

3. The therapy method of claim 2 wherein said step of ambulating the staff includes rotating the staff about an axis extending vertically from the toe portion.

4. The therapy method of claim 1 wherein said step of extending the arm includes fully extending the arm.

5. The therapy method of claim 1 wherein said engaging step includes engaging the hand at the upper portion.

6. The therapy method of claim 1 wherein said engaging step includes engaging the arm with a wrist strap connected to the staff.

7. The therapy method of claim 1 wherein said engaging step includes engaging the staff by grasping the staff with the hand.

8. The therapy method of claim 1 wherein said maintaining step includes maintaining the toe portion at a stationary point on a substantially vertical surface.

9. The therapy method of claim 1 wherein said engaging step includes suspending the arm from the staff with a wrist strap.

10. The therapy method of claim 1 wherein the staff includes an adjustable length staff.

11. A physical therapy method for treatment of an ailment of the shoulder of a patient and using a staff having a toe portion and an upper portion, said method comprising the steps of:

maintaining the toe portion of the staff at a stationary point on a surface;

engaging the staff with the patient's arm corresponding to the patient's ailing shoulder;

extending the patient's arm in a spaced clearance position from the patient's body; and ambulating the patient's arm and the staff to treat the ailing shoulder.

12. The physical therapy method according to claim 11 wherein said step of engaging includes engaging the patient's wrist with a wrist strap attached to the staff.

13. The physical therapy method according to claim 11 wherein said step of ambulating the patient's arm includes moving the arm to precise positions as determined by the patient in accordance with pain tolerance.

14. A physical therapy method of ambulating the shoulder muscles of a patient having undergone rotator-cuff surgery and unable to independently sustain extension of the arm from the body, said method comprising the steps of:

selecting a staff of a selected length size as measured from a toe portion to an upper portion of the staff;

engaging the arm with the upper portion of the staff;

extending the arm in a spaced clearance position from the body while maintaining the toe portion at a substantially stationary point on a surface;

whereby the patient's arm is supported by the staff so that a patient may treat the shoulder muscles having undergone surgery.

15. The physical therapy method according to claim 14 wherein said step of engaging includes engaging the patient's wrist with a wrist strap attached to the staff.

16. The physical therapy method according to claim 14 including the step of ambulating the patient's arm for treatment of the shoulder muscle ailment.

17. The physical therapy method according to claim 14 wherein said step of extending the arm is conducted while standing.

18. The physical therapy method according to claim 14 wherein said step of extending the arm includes maintaining the body in a relatively stationary position throughout said method.

19. The physical therapy method according to claim 14 wherein said step of extending the arm includes fully extending the arm.

20. An adjustable staff for use in therapeutic shoulder treatment of the type involving engaging the staff with the arm of a patient and extension of the arm of the patient from the body of the patient while maintaining said staff in stationary contact with a surface, said staff comprising:

a first length of supporting material defining a surface-engaging member;

a second length of supporting material defining an arm-engaging member;

a screw fastener for length-wise adjustability connecting said surface-engaging member with said arm-engaging member; and a wrist wrap in attached relation to said arm-engaging member and having a loop for receiving and suspending the wrist of a patient during operation of the shoulder treatment.

21. An adjustable staff according to claim 20 wherein said wrist wrap includes a swivel.

22. An adjustable staff according to claim 20 wherein said staff includes a therapy band.

23. An adjustable staff according to claim 20 wherein said wrist wrap is connected to an O-ring positioned on said staff.

24. An adjustable staff according to claim 21 wherein said swivel is connected to an O-ring positioned on said staff.

* * * * *